United States Patent [19]

Slack

[11] 4,164,161

[45] Aug. 14, 1979

[54] MODIFIED STAPLE CUTTER

[75] Inventor: Philip T. Slack, Halifax, England

[73] Assignee: Plasticisers Limited, Near Bradford, England

[21] Appl. No.: 873,703

[22] Filed: Jan. 30, 1978

[51] Int. Cl.[2] ..... D01G 1/04

[52] U.S. Cl. ..... 83/346; 83/913; 83/100; 83/310

[58] Field of Search ..... 83/346, 341, 913, 100, 83/116, 310

[56] References Cited

U.S. PATENT DOCUMENTS

| | | | |
|---|---|---|---|
| 2,808,884 | 10/1957 | Shann et al. | 83/913 X |
| 3,834,263 | 9/1974 | Smith | 83/346 |
| 4,014,231 | 3/1977 | Hutzezon | 83/346 |

*Primary Examiner*—Donald R. Schran

*Attorney, Agent, or Firm*—Scrivener, Parker, Scrivener & Clarke

[57] ABSTRACT

The present specification describes and claims a method and apparatus for cutting elongate material into predetermined lengths. The apparatus comprises a cutting assembly including a cutter wheel having a number of spaced apart knife edges projecting radially outwardly in the region of its periphery. Winding means are provided for winding successive layers of material to be cut in contact with the knife and a pressure wheel forces the material onto the knife edges as the cutter wheel rotates. Press nip rollers are arranged to feed the material to the cutter wheel and both the cutter wheel and the press nip rollers are driven by the same motor.

5 Claims, 1 Drawing Figure

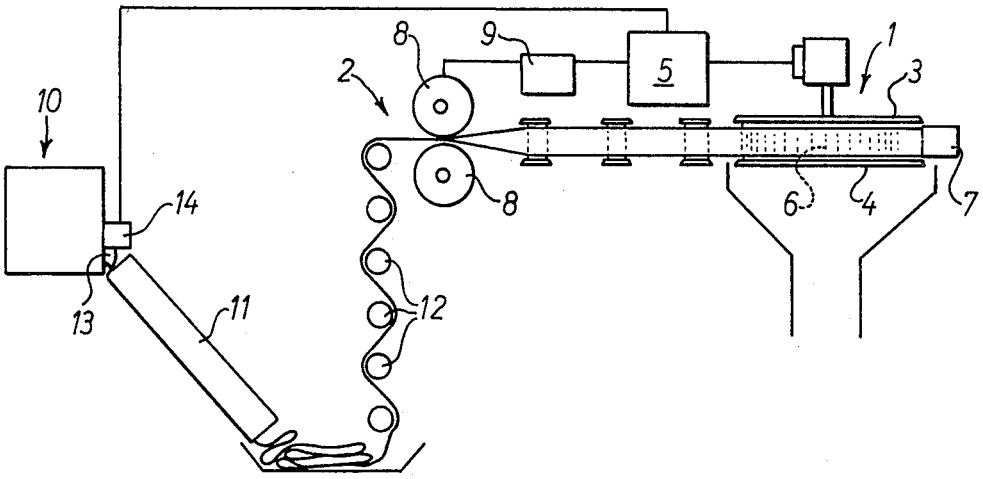
10
14
13
11
2
8
9
5
8
1
3
6
4
7
12

MODIFIED STAPLE CUTTER

The present invention relates to an apparatus and method for cutting continuous elongated material, such as filamentary material, into predetermined shorter lengths.

Such apparatus when used to cut fibres, is commonly termed a staple cutter and the present invention particularly relates to a staple cutter of the type disclosed in British Patent Specification No. 1,204,363 (Eastman Kodak Company). This apparatus comprises a cutting assembly in the form of a wheel having a number of spaced apart knives located in the region of its periphery, the knife edges projecting radially outwardly with respect to the wheel. In use the wheel is rotated by a motor and the fibres to be cut are wound around the wheel on top of the knife edges. When a number of layers have been wound onto the wheel a pressure wheel engages the outermost layer thus pressing the innermost layer against the knife edges and cutting the fibres in this layer. The cut fibres pass between the knives inwardly of the wheel, and are conveyed away from the central region of the wheel to a storage zone, preferably by the use of air currents. The main use of such apparatus is in the cutting of crimped fibres, the fibres passing from a crimping machine to the apparatus and being tensioned as they are wound onto the cutter wheel, so that the crimp is removed or virtually removed before the fibres are cut. As soon as the fibres are cut the crimp reduces the length of the cut fibres, facilitating the passage of the fibres between the knives.

The tensioning of the fibres in the apparatus disclosed in British Patent Specification No. 1,204,363 is effected by guides in the form of cylindrical rods, the rods being arranged substantially parallel to each other so as to cause the tow of fibres fed to the apparatus to flatten out and follow a zig-zag path. The friction between the fibres and the rods tensions the fibres and so reduces the crimp.

It has been found that different tensions are necessary for different fibres, a greater tension being required for fibres having a relatively large amplitude and wave length than the tension required for fibres having a smaller crimp. To provide this variable tension it has been known to provide a variable speed press nip between the crimping machine and the cutter wheel of the staple cutter apparatus. The press nip was formed by a pair of contiguous rollers and was driven by its own motor. By varying the speed of the press nip motor and the speed of the motor rotating the cutter wheel, the speed of operation of the apparatus and the tension of the fibres wound onto the cutter wheel could be varied. Assuming a predetermined rotational speed for the cutter wheel, the tension of the fibres could be increased by slowing the press nip or reduced by increasing the speed of the press nip relative to the speed of the cutter wheel. However, in practice it was found that whilst the speeds of the respective motors could be adjusted to provide the desired tension for a particular type of fibre, these speeds could, even when set, vary relative to each other and thus vary the tension. This was primarily due to the fact that electric motors were used and voltage variations or load variations on each motor caused the motor speeds to vary differently.

It is an aim of the present invention to provide an apparatus of the above described type wherein the tension of the fibres fed onto the cutter wheel can be maintained substantially constant irrespective of any variations which may affect the drive.

According to the present invention there is provided an apparatus for cutting elongate material into predetermined lengths comprising press nip rollers arranged to feed the material to a cutting assembly including a number of spaced apart knive edges secured to a mounting member, the cutting assembly having winding means for winding successive layers of material to be cut in contact with the knife edges, and means for forcing the material onto the knife edges to thereby sever the material, common motor means being arranged to drive the winding assembly and the press nip rollers.

Thus by having a single motor to drive both the winding means and the press nip rollers the tension of the material can be maintained substantially constant, any factors affecting the motor merely producing a change in the speed of operation of the apparatus as a whole.

According to a further feature of the present invention there is provided a method of cutting elongate material into predetermined lengths comprising the steps of feeding the material between press nip rollers driven by a motor and winding a plurality of layers onto winding means also driven by said motor, the winding means forming part of a cutting assembly which includes a number of spaced apart knive edges secured to a mounting member, and means for forcing the material onto the knife edges to thereby sever the material.

In a preferred embodiment of the present invention the cutting assembly includes a cutter wheel having a number of spaced apart knives located in the region of its periphery, the knife edges projecting radially outwards with respect to the wheel. The cutter wheel is rotatably driven by a motor which also drives the press nip rollers. The drive from the motor to the press nip rollers has a variable transmission so that the speed of the press nip rollers can be adjusted relative to the motor speed and thus relative to the speed of the cutter wheel. By this variable transmission the tension of the material wound onto the cutter wheel can therefore be adjusted to suit the type of material to be cut. The preferred use of the apparatus is the cutting of crimped continuous fibres into predetermined short lengths. By varying the transmission to the press nip the tension of the fibres wound onto the cutter wheel may be adjusted to suit a particular crimp i.e., to virtually remove the crimp prior to cutting. To actually cause the cutting of the fibres adjacent the knife edges a pressure wheel engages the fibres wound onto the cutter wheel. As an alternative to a pressure wheel which may be adjustable, any suitable pressure means may be substituted to force the fibres against the knife edges.

In an alternative embodiment of the present invention the variable transmission is arranged to adjust the drive to the cutter wheel, the press nip rollers being driven either directly or through a specific, non-adjustable gear train.

In the preferred use of the present invention with the apparatus cutting crimped fibres, the apparatus is fed from a crimping machine. In this case the output of the crimping machine is monitored and dependent upon the output the speed of the cutting apparatus may be controlled. Thus if there is an excess of crimped material delivered by the crimping machine the motor driving the press nip rollers and the cutter wheel of the cutting apparatus is speeded up to reduce this excess. If, however, there is not enough material to satisfy the demand of the cutting apparatus the motor speed is reduced. This control is preferably automatic with a proximity switch monitoring the amount of material at the output of the crimping machine.

The present invention will now be further described, by way of example, with reference to the drawing accompanying the Provisional Specification in which a schematic view of a preferred embodiment of the present invention is shown.

In the embodiment of the present invention illustrated in the accompanying drawing the essential components are the cutting assembly 1 and the press nip 2. The cutting assembly 1 comprises a cutter wheel formed by two annular discs 3 and 4 fixed together coaxially with respect to each other and arranged to be driven by electric motor 5. Between the annular discs 3 and 4 are fixed a plurality of spaced apart knives 6, each knife extending radially with respect to the discs 3,4 with its knive edge radially outermost. The cutting assembly also includes a pressure wheel 7 which, in use, presses the material to be cut against the knife edges. The position of the pressure wheel 7 is adjustable and it can be moved away from the discs 3 and 4 to enable replacement of the discs and knives. The cutting assembly 1 is encased in a housing (not shown) so that cut material passing between the knives 6 to the centre of the cutter wheel can drop downwards, entrained by induced air currents, and be collected.

Motor 5, besides driving cutting wheel, also drives the rollers 8 constituting the press nip 2. However, this drive is via a variable transmission 9, such as a Kopp regulator. Thus by adjusting this transmission 9 the speed of the press nip rollers 8 can be varied relative to the speed of the cutter wheel, so varying the tension of material fed from the press nip 2 to the cutter wheel. This variable transmission 9 can alternatively be located in the drive to the cutter wheel and still obtain the desired effect. By the use of a single motor 5 for both the press nip 2 and the cutter wheel the tension of the material wound onto the cutter wheel can be set by means of the variable transmission and should any load or other parameter, affect the motor 5 then the tension will be maintained even though the motor may slow.

As seen in the accompanying drawing, the press nip 2 is fed with crimped material from a crimping machine 10, the tow of crimped material passing along a chute 11 from where it is straightened out by it being passed around cylindrical bars 12 before entering press nip 2. The outlet 13 of the crimping machine is provided with a sensor switch 14 which is adapted to sense the quantity of fibre leaving the crimping machine. This switch then controls the motor 5 via suitable electronic circuitry so that if an excess of fibre leaves the crimping machine then motor 5 is speeded up to cut this fibre and reduce the excess, and should the output of the crimping machine decrease then the speed of motor 5 is reduced.

I claim:

1. An apparatus for cutting elongate material into predetermined lengths comprising a cutting assembly including a number of spaced apart knife edges secured to a mounting member, winding means for winding successive layers of material to be cut in contact with the knife edges, means for forcing the material onto the knife edges to thereby sever the material, press nip rollers arranged to feed the material to the cutting assembly, common motor means having an operative connection with both the winding means and the press nip rollers, and variable transmission means in said operative connection for varying the relative speeds of the winding means and the press nip rollers,

2. An apparatus according to claim 1, wherein the variable transmission is provided between the common motor means and the press nip rollers.

3. An apparatus according to claim 1, wherein the common motor means is an electric motor.

4. An apparatus according to claim 1, wherein the cutting assembly includes a cutter wheel having a number of spaced apart knives located in the region of its periphery, the knife edges projecting radially outwardly of the wheel which is rotatable by means of said common motor means.

5. An apparatus according to claim 4, wherein a pressure roller is arranged to engage material wound onto the cutter wheel and forms said means for pressing the material against said knife edges.

* * * * *